US009194195B2

(12) United States Patent
Tienari

(10) Patent No.: US 9,194,195 B2
(45) Date of Patent: Nov. 24, 2015

(54) CONTROL EQUIPMENT FOR CONTROLLING DRILL ROD

(75) Inventor: Ossi Tienari, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 226 days.

(21) Appl. No.: 13/985,422

(22) PCT Filed: Feb. 16, 2012

(86) PCT No.: PCT/FI2012/050150
§ 371 (c)(1),
(2), (4) Date: Aug. 14, 2013

(87) PCT Pub. No.: WO2012/110704
PCT Pub. Date: Aug. 23, 2012

(65) Prior Publication Data

US 2013/0319771 A1 Dec. 5, 2013

(30) Foreign Application Priority Data

Feb. 18, 2011 (FI) ..... 20115158

(51) Int. Cl.
*E21B 19/24* (2006.01)

(52) U.S. Cl.
CPC ..... *E21B 19/24* (2013.01)

(58) Field of Classification Search
CPC ..... E21B 19/24
See application file for complete search history.

(56) References Cited

U.S. PATENT DOCUMENTS

| | | | | |
|---|---|---|---|---|
| 3,503,460 | A | 3/1970 | Gadbois | |
| 4,096,608 | A | 6/1978 | Lagerstedt | |
| 4,438,984 | A * | 3/1984 | Leppala | 384/24 |
| 6,971,283 | B2 | 12/2005 | Belik | |
| 7,428,936 | B2 | 9/2008 | Hinshaw | |
| 7,816,994 | B2 | 10/2010 | Maat | |
| 2003/0116360 | A1 | 6/2003 | Jonsson et al. | |
| 2003/0205112 | A1 | 11/2003 | Hawkins | |
| 2005/0076744 | A1 | 4/2005 | Pietras et al. | |
| 2007/0131416 | A1 | 6/2007 | Odell et al. | |
| 2008/0093126 | A1 | 4/2008 | Franzen | |
| 2010/0270033 | A1 * | 10/2010 | Angelle et al. | 166/380 |

FOREIGN PATENT DOCUMENTS

| | | | |
|---|---|---|---|
| CN | 101253305 | A | 8/2008 |
| CN | 101429856 | A | 5/2009 |
| CN | 201354604 | Y | 12/2009 |
| JP | 551871991 | | 5/1991 |
| JP | 428991994 | | 6/1994 |
| JP | H06206187 | | 7/1994 |
| RU | 2109914 | C1 | 4/1998 |
| WO | 0236927 | A1 | 5/2002 |
| WO | 2012083050 | A2 | 6/2012 |

* cited by examiner

*Primary Examiner* — William P Neuder
(74) *Attorney, Agent, or Firm* — Corinne R. Gorski

(57) ABSTRACT

Control equipment for guiding a drill rod. The control equipment including a frame and two guide jaws provided with guide surfaces and mounted movably in relation to the frame. The drill rod is set between the guide jaws during drilling. Actuators move the guide jaws in relation to the drill rod. Synchronization means are coupled between the guide jaws, such that the guide jaws always move in opposite directions to one another and at the same speed. A detector detects that the guide surfaces of the guide jaws are in contact with the drill rod.

9 Claims, 2 Drawing Sheets

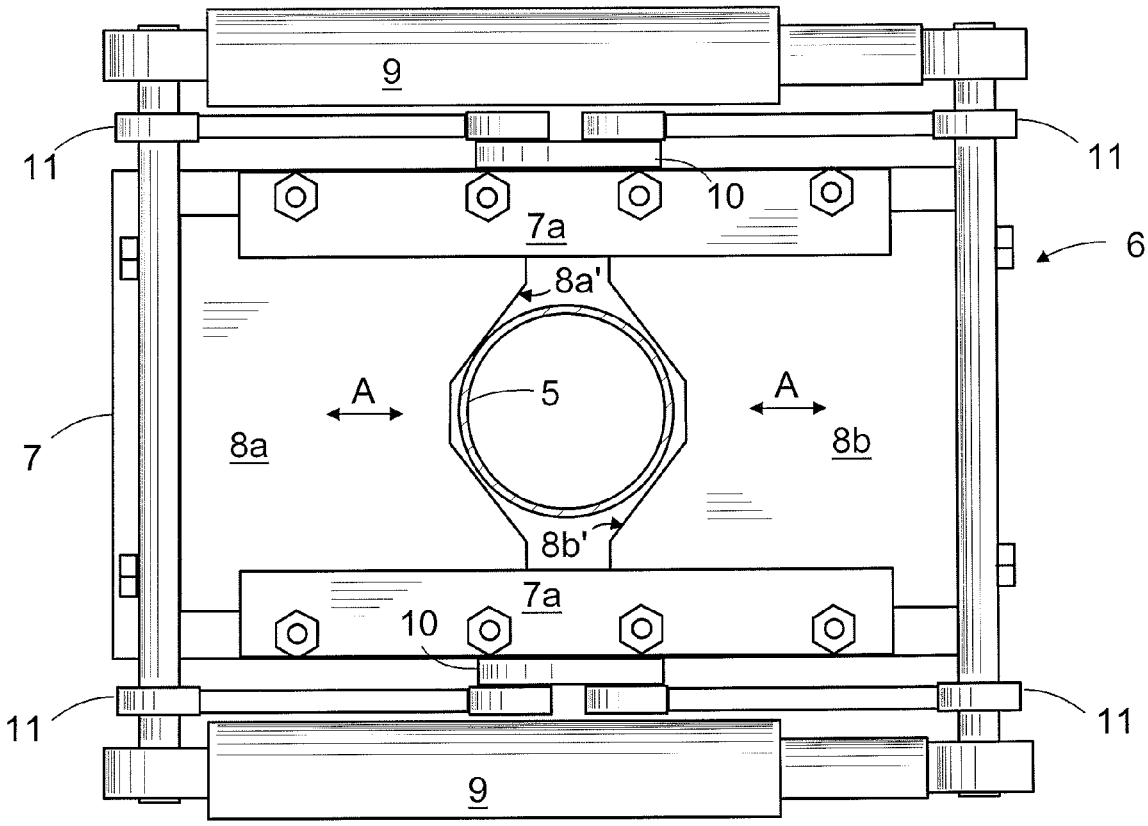
FIG. 2a
FIG. 2b
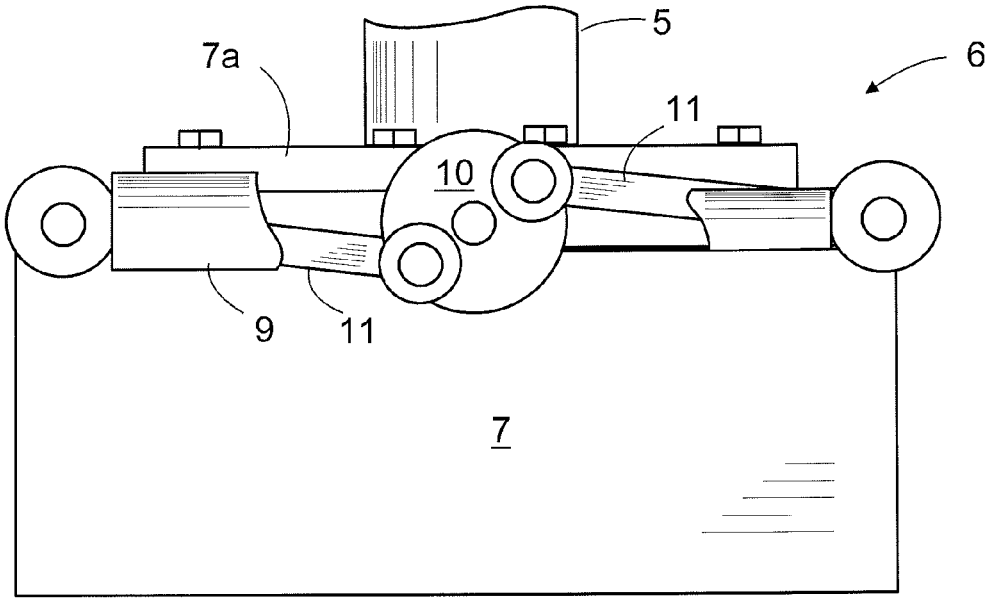

CONTROL EQUIPMENT FOR CONTROLLING DRILL ROD

RELATED APPLICATION DATA

This application is a §371 National Stage Application of PCT International Application No. PCT/FI2012/050150 filed Feb. 16, 2012 claiming priority of Finnish Application No. 20115158, filed Feb. 18, 2011.

BACKGROUND OF THE INVENTION

The invention relates to control equipment for guiding a drill rod, the control equipment comprising a frame, two guide jaws provided with guide surfaces and mounted to be linearly movable in relation to the frame, between which guide jaws the drill rod is to be set during drilling, and actuators for moving the guide jaws transversely to the drill rod axis for moving them away from one another, and correspondingly, towards one another in order for guiding the drill rod.

Drilling rigs often employ drill rods of different diameters, typically two different drill rods. During drilling the drill rods must be guided and for that there are typically employed two separate controllers, i.e. one for each rod diameter. Each guide requires a separate hydraulic system for operating the controller, and consequently the operator must also have separate control means for each guide, respectively. Further, the use of double devices increases the weight of the equipment, and in particular in a location disadvantageous to the equipment, i.e. at the end of a feed device.

From U.S. Pat. No. 7,814,994 is known a solution which employs one device for supporting rods of different diameters. This solution comprises generally V-shaped guide jaws on either side of the drill rod and they are both fed with a specific hydraulic cylinder towards the drill rod until they come into contact with the drill rods. This device works unreliably to some extent, because the guide jaws may move differently, and there is no certainty whatsoever about the actual position of the guide jaws. In addition, in the solution of the publication the guide jaws in the guide position are in continuous contact with the drill rod, which causes unnecessary friction and wear.

BRIEF DESCRIPTION OF THE INVENTION

The object of the present invention is to provide a controller, by which it is possible to manipulate drill rods of different diameters in an easy and simple manner and which is easy to operate and reliable in operation. The controller of the invention is characterized by including a detector which detects that guide surfaces of guide jaws are in contact with the drill rod.

The basic idea of the invention is that the actuating devices of the guide jaws comprise detecting elements, such as a detector, by means of which is detected a situation where the guide jaws clamp the drill rod. Further, the idea of an embodiment of the invention is that the guide jaws are interconnected in a forced controlled manner so that they both always move simultaneously in the same direction and the same distance. Thus the drill rod is always centralized exactly in the correct position, irrespective of the conditions and the diameter. Further, according to an embodiment of the invention, it comprises a control unit for controlling the guide jaws to move a short distance away from the drill rod in such a way that they do not clamp the drill rod and they are not in continuous contact with its surface. According to yet another embodiment of the invention, the detecting elements include a pressure sensor, which detects a pressure rise in the hydraulic fluid of a feed cylinder for the guide jaws and on the basis of whose signal the control equipment make the guide jaws move off the drill rod.

The control equipment of the invention has an advantage that just one pair of guide jaws is needed for guiding rods of different diameters. It has a further advantage that it is simple and easy to use, because the operator only needs to switch the closing movement of the guide jaws and the control equipment performs the rest automatically, i.e. it detects the position of the guide jaws according to the particular drill rod in use and releases the drill rod from the guide jaw clamp automatically. In addition, the weight of the control equipment is considerably lower compared to conventional prior art solutions.

BRIEF DESCRIPTION OF FIGURES

The invention is now described in greater detail in the attached drawings, in which FIGS. 2*a* and 2*b* are schematic perspective views of the structure of the control equipment according to the invention.

DETAILED DESCRIPTION OF THE INVENTION

Figure 1:
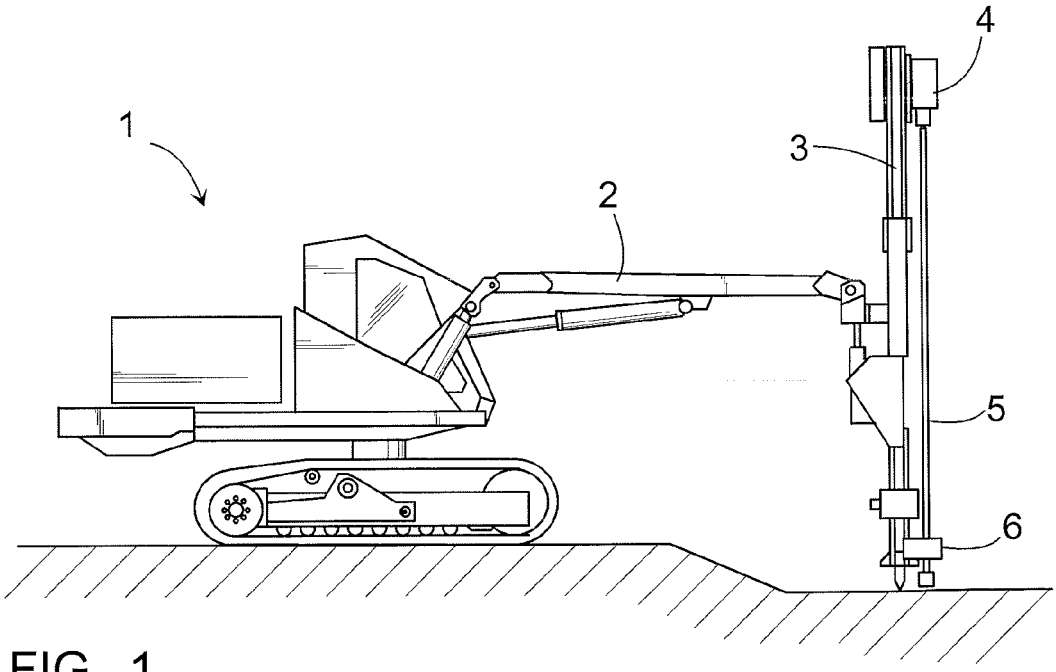
FIG. 1 shows schematically a rock drilling rig, in which control equipment is used.

FIG. 1 shows schematically a drilling rig, which comprises a carrier 1, to which is connected a boom 2. To the boom 2, in turn, is mounted a feed beam 3 on which a drilling machine 4 moves. To the drilling machine 4, in turn, is coupled a drill rod 5, and at the lower end of the feed beam 3 there is control equipment 6 for guiding the drill rod 5.

FIGS. 2*a* and 2*b* are schematic perspective views of the control equipment according to the invention. The control equipment 6 includes a frame 7 and two opposing guide jaws 8*a* and 8*b* which are mounted to move linearly in relation to the frame 7 and which are coupled to move on either side of the drill rod 5 in transversal direction thereto. For moving the guide jaws, the control equipment 6 comprises actuators 9, in this case hydraulic cylinders on either side of the guide jaws 8*a* and 8*b*, so that a symmetrical force is exerted on the guide jaws. Each guide jaw 8*a* and 8*b* comprises a guide surface 8*a'* and 8*b'*, respectively, which control the drill rod 5.

To synchronize the guide jaw movements such that they move in mutually opposite directions at the same speed, and consequently, the same distance, there are connected synchronizing means between the guide jaws. In the embodiment of FIG. 2, the synchronizing means consist of coupling elements 10, in this example discs, which are rotatably mounted on either side of the guide jaws in the frame 8*b*, and from the opposite side of the disc axis transmission arms 11 go to the guide jaws. In theory, the disc rotation axes may have various directions, but for practical reasons it is simplest to mount the discs in such a manner that the rotation axis of each disc is perpendicular to the motion direction of the guide jaws. The lengths of the transmission arms 11 are mutually equal in order for the travels of the guide jaws to be exactly the same, and correspondingly, the disc axis is at the central axis of the drill rod 5.

When hydraulic fluid is conducted into a hydraulic cylinder, into either one of its cylinder chambers, the piston of the hydraulic cylinder moves. Because the hydraulic cylinder is coupled at one end to one guide jaw, in this example to the guide jaw 8*a*, and the end of the piston rod is correspondingly coupled to the opposing guide jaw, in this case 8*b*, the motion of the piston makes the distance between the guide jaws either shorter or longer. As the guide jaws 8*a* and 8*b* move, the transmission arms 11 move correspondingly along with the guide jaws and rotate the coupling element 10. i.e. the disc. The rotation of the disc, in turn, has the effect that the guide jaws 8*a* and 8*b* always forcibly move in opposite directions at the same speed, and thus the length of movement in the guide jaws 8*a* and 8*b* is also mutually the same. The transmission arms 11 are connected at both ends to the disc, rotatably about the axis parallel to the disc axis, on the opposite sides of the axis at the same distance, and correspondingly rotatably in relation to the guide jaw 8*a* or 8*b*. Instead of the disc, it is also possible to use as the coupling element 10 just a support arm with similar bearing, or the like, between the transmission arms 11.

Figure 3:
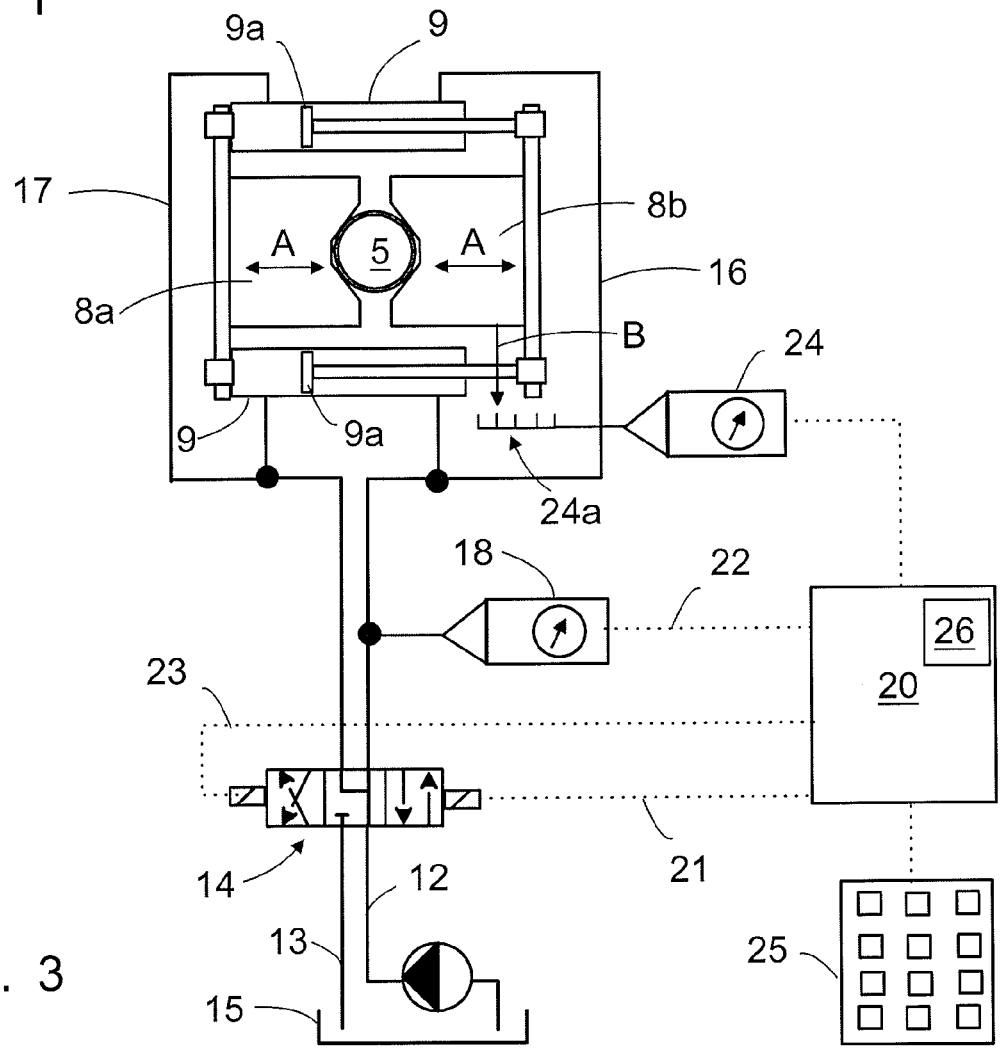
FIG. 3 is a schematic view of a hydraulic system for operating the control equipment of the invention.

FIG. 3 is a simple schematic view of a hydraulic system for operating the guide jaws of the control equipment. The hydraulic fluid is fed to the hydraulic cylinders via hydraulic fluid channels 12 and 13 such that the hydraulic fluid is fed along the channel 12 to a control valve 14 and the hydraulic fluid returns to a hydraulic fluid container 15 along the channel 13. The control valve 14 is electrically controlled and it allows the hydraulic fluid to be conducted to each cylinder chamber of the hydraulic cylinders either along the channel 16 to close the guide jaws or along the channel 17 to open the guide jaws. Accordingly, the other one of the channels 16 and 17 serves as a return channel for the hydraulic fluid.

For automatic control in the closing step of the guide jaws the channel 16 comprises a detector 18, in this case a pressure sensor. As the guide jaws are being closed, hydraulic fluid is fed to the hydraulic cylinders, controlled by a control unit 20, whereby the control unit 20 transmits a control signal along a control channel 21 to the control valve 14. When the guide jaws come into contact with the surface of the drill rod 5 on both sides, they will no longer be able to move in that direction. This, in turn, results in the pressure rising in the channel 16. The pressure sensor detects a pressure rise in the channel 16, when the guide surfaces 8*a'* and 8*b'* of the guide jaws 8*a* and 8*b* are in contact with the drill rod 5, i.e. they press against the surface of the drill rod 5 and are no longer able to move further towards the drill rod.

The pressure rise is indicated on a signaling channel 22 to the control unit 20 which discontinues hydraulic fluid feed on the basis thereof in the closing direction of the guide jaws. Thereafter the control unit 20 connects the hydraulic fluid feed momentarily to the channel 17 by means of the valve 14, via a control channel 23, in such a manner that the guide jaws 8*a* and 8*b* move a minor distance, a few millimeters at most, away from the drill rod 5 so that a clearance will be provided between the guide jaws 8*a* and 8*b* and the drill rod, within which clearance the drill rod 5 may move without being in continuous contact with either guide jaw.

The control equipment further includes measuring means 24, which measure the position of the guide jaws 8*a* and 8*b* in relation to the control equipment frame. When the diameter of the drill rod 5 is known, the position of the guide jaws 8*a* and 8*b* in each particular control position and the diameter of the drill rod or other data identifying the drill rod may be stored in the memory of the control unit 20, and consequently, when a drill rod of the same diameter is subsequently used, the guide jaws may be moved directly to a correct guide position, controlled by the control unit 20, without having to separately detect the contact of the guide jaws with the drill rod. So, after the first drilling performed using a given diameter, it was possible to store the position of the guide jaws for said diameter, and then gradually for all drill rods to be used in the apparatus there will be provided preset position information on the guide jaws. In that case, every time the diameter of the drill rod changes the driller may select the required position of the guide jaws with a control device 25 directly from the memory of the control unit 20.

Because the guide jaws wear in use, the position of the guide jaws required by a given drill rod diameter may be checked, if so desired, by carrying out the whole process from beginning to end, whereby the wear in the guide jaws will be compensated for.

The invention is described above in the specification and the drawings by way of example only and it is not in any way limited thereto. The synchronization of the guide jaw movement may be provided by a plurality of different solutions, such as a gear rack, link mechanism, etc. Also, the synchronization of the guide jaw movement may be provided by using known, so-called pilot cylinder solutions, in which the movement of one hydraulic cylinder feeds hydraulic fluid from said hydraulic cylinder to a corresponding hydraulic cylinder chamber of a similar hydraulic cylinder, and consequently the movement in one hydraulic cylinder produces an equal movement in the other hydraulic cylinder.

Instead of the pressure sensor, it is possible to use, as the detector, various motion sensors or detectors indicating hydraulic fluid flow rate, whereby ending of motion or hydraulic fluid flow produces a detection for controlling the equipment. Instead of guide jaw position determinations performed with drill rods, the guide jaw position data may be entered in the memory of the control unit 20, when the same position determinations have been performed on similar guide jaws by some other control equipment. It will be obvious to a person skilled in the art that as technology advances, the basic idea of the invention may be implemented in a variety of ways. The invention and its embodiments are thus not restricted to the examples described above but may vary within the scope of the claims.

The invention claimed is:

1. Control equipment for guiding a drill rod, the control equipment comprising:

a frame;

two guide jaws, each provided with guide surfaces and mounted to be linearly movable in relation to the frame the drill rod being set between the guide jaws during drilling;

actuators for moving the guide jaws transversely to an axis of the drill rod for moving them away from one another, and correspondingly, towards one another for guiding the drill rod;

a detector for detecting that the guide surfaces of the guide jaws are in contact with the drill rod; and synchronization means coupled between the guide jaws so that the guide jaws always move in opposite directions to one another and at the same speed.

2. The control equipment of claim 1, wherein the actuators are hydraulic cylinders by which the jaws are moved.

3. The control equipment of claim 2, wherein the detector is a pressure sensor, which detects a pressure rise in hydraulic fluid in a hydraulic fluid feed channel of the hydraulic cylinders of the guide jaws when the guide jaws come to a halt against a surface of the drill rod.

4. The control equipment of claim 1, further comprising measuring means for indicating a position of the guide jaws.

5. The control equipment of claim 1, further comprising a control unit for controlling the movement of the guide jaws.

6. The control equipment of claim 5, wherein the detector is connected to the control unit and the control unit is arranged to automatically move the guide jaws for a predetermined distance away from the drill rod to a guide position, when a signal is received from the detector that the guide jaws are in contact with the drill rod.

7. The control equipment of claim 6, wherein the control unit includes memory means for storing the position of the guide jaws and the information on the drill rod in the memory thereof when the guide jaws are moved off the drill rod to the guide position.

8. The control equipment of claim 7, wherein the control unit may be set to move the guide jaws directly to a correct guide position in accordance with a selected drill rod.

9. The control equipment of claim 1, wherein the synchronization means include coupling elements rotatably mounted on the frame of the control equipment and transmission arms which are rotatably mounted at both ends and arranged with the coupling elements, on the opposite sides of their rotation axes, and to either guide jaw.

* * * * *